United States Patent [19]

Spivey et al.

[11] Patent Number: 4,880,326

[45] Date of Patent: Nov. 14, 1989

[54] LIPSTICK DISPENSER

[75] Inventors: James R. Spivey, Irvine; William J. Dee, Chino, both of Calif.

[73] Assignee: Spiveco, Inc., Anaheim, Calif.

[21] Appl. No.: 198,390

[22] Filed: May 24, 1988

[51] Int. Cl.[4] ..... A45D 40/00; A45D 40/06

[52] U.S. Cl. ..... 401/123; 401/124; 401/126; 401/130; 401/191

[58] Field of Search ..... 401/123, 124, 126, 127, 401/129, 191, 175, 130; 132/289, 290

[56] References Cited

U.S. PATENT DOCUMENTS

| | | | |
|---|---|---|---|
| Re. 21,757 | 4/1941 | Deakers et al. | 132/79 |
| 1,309,900 | 7/1919 | MacCorkell | 401/175 |
| 1,497,442 | 6/1924 | Hess | 401/129 |
| 2,193,509 | 3/1940 | Deakers et al. | 401/126 |
| 2,311,367 | 4/1940 | Chambers | 221/147 |
| 2,320,749 | 1/1943 | Pressentin | 221/79 |
| 2,442,503 | 6/1948 | Melnikoff | 132/88.7 |
| 2,620,499 | 12/1952 | Dressel | 15/140.3 |
| 2,917,765 | 12/1959 | Jakubowski | 15/137 |
| 3,100,315 | 8/1963 | Laxalt | 15/558 |
| 3,121,905 | 2/1964 | Shapiro | 15/552 |
| 3,185,345 | 5/1965 | Hunegs | 222/45 |
| 3,195,545 | 7/1965 | Lederberg et al. | 132/79 |
| 3,226,762 | 1/1966 | Norman | 15/558 |
| 3,246,657 | 4/1966 | Roller | 132/79 |
| 3,384,547 | 5/1968 | Palmerio et al. | 167/85 |
| 3,589,821 | 6/1971 | Barney et al. | 401/75 |
| 3,802,023 | 4/1975 | Spatz | 15/192 |
| 3,807,881 | 4/1974 | Seidler | 401/175 |
| 4,071,300 | 1/1978 | Nichols et al. | 401/175 |
| 4,201,490 | 5/1980 | D'Angelo | 401/175 |
| 4,269,207 | 5/1981 | Konrad et al. | 132/84 B |
| 4,348,126 | 9/1982 | Nigro | 401/135 |
| 4,363,560 | 12/1982 | Gentile | 401/68 |
| 4,552,161 | 11/1985 | Hill et al. | 132/88.5 |
| 4,664,547 | 5/1987 | Rosenwinkel | 401/175 |

FOREIGN PATENT DOCUMENTS

| | | | |
|---|---|---|---|
| 496055 | 10/1919 | France | 401/175 |
| 36749 | 5/1930 | France | 401/126 |
| 727609 | 3/1932 | France | 401/175 |

*Primary Examiner*—Steven A. Bratlie

*Attorney, Agent, or Firm*—Gordon L. Peterson; Loyal M. Hanson

[57] ABSTRACT

A dispenser for a flowable substance more viscous than water includes an applicator member and a cover member that can be separated for use and rejoined for storage. The applicator member has an applicator tip to be used for application purposes, the cover member has a hollow interior that extends to an open end, which open end is dimensioned and arranged to receive the applicator tip, and the cover member contains a supply of the substance and an extrusion mechanism for extruding an amount of the substance toward the open end. The extrusion mechanism includes components for enabling a user to operate the extrusion mechanism by rotating the applicator member relative to the cover member while the applicator tip is within the open end.

21 Claims, 2 Drawing Sheets

10
11
12
13
14
15
16
17
19
20
21
23
25
28
31
32
34
35
38
39
40
41
3
4

LIPSTICK DISPENSER

BACKGROUND OF THE INVENTION

1. Technical Field

This invention relates generally to dispensers for flowable substances, and more particularly to a new and improved lipstick dispenser.

2. Background Information

Some lipstick dispensers employ a two-piece unit about the size of a fountain pen, one piece serving as an applicator and the other as a cover for the applicator tip. The unit contains a supply of lipstick within one of the two pieces along with an extrusion mechanism that operates to dispense a desired amount onto the tip. Lipstick application with a dispenser of this type has become widespread and so the details of construction and operation are important.

Use involves grasping the cover with one hand and the applicator with the other in order to separate them with a slight tug like the two pieces of a pen. Then, releasing one of the pieces, the user rotates the two ends of the other piece relative to each other in order to operate the extrusion mechanism within. This extrudes the desired amount for application after which the user places the cover back over the tip.

Although this arrangement is convenient in some respects, there are certain drawbacks that need to be overcome. For example, some lipstick dispensers carry the supply of lipstick within the body of the applicator and they operate to extrude the lipstick through the applicator tip toward the outer surface of the tip. But this arrangement may result in an uneven distribution of lipstick across the tip surface as well as an applicator that is heavier than desired.

Furthermore, the extrusion mechanism is often somewhat complicated, costly to fabricate, and inconvenient to operate. For example, it may include a piston within the applicator that can be advanced against the lipstick supply for extrusion purposes by rotating the tip end of the applicator relative to the other end. However, this is sometimes difficult to do without setting down or at least releasing the cover in order to free both hands for operation of the extrusion mechanism. This may in turn result in extra time and effort as well as the possibility of misplacing the cover.

Consequently, it is desirable to have a new and improved lipstick dispenser that overcomes these concerns.

SUMMARY OF THE INVENTION

This invention solves the problems outlined above with a lipstick dispenser having an extrusion mechanism in the cover that is operated by moving the applicator relative to the cover while the cover is still on. The applicator engages coupling components in the cover to cause the extrusion mechanism to operate and extrude lipstick onto the applicator tip.

Thus, neither the cover nor the applicator need be released or laid aside during the lipstick application process. In other words, the user grasps the cover with one hand and the applicator with the other, and then moves the two relative to each other before separating them. Once the desired amount of lipstick is dispensed in this manner onto the tip, the user separates the two pieces and applies the lipstick, still without having to release the cover.

In addition, the above arrangement enables the user to spread the lipstick more evenly over the surface of the tip. First, the user withdraws the applicator just slightly from the cover to disengage the drive components. Then the user rotates the applicator relative to the cover in order to spread the lipstick before fully separating the cover and applicator.

Generally, a lipstick dispenser constructed according to the invention includes an applicator member and a cover member that can be separated for use and rejoined for storage. The applicator has an applicator tip to be used for lipstick application purposes, the cover member has a hollow interior that extends along a cover member axis to an open end of the cover member, which open end is dimensioned and arranged to receive the applicator tip, and the cover member contains a supply of lipstick and an extrusion mechanism for extruding an amount of the lipstick toward the open end.

According to a major aspect of the invention, the extrusion mechanism includes components for enabling a user to operate the extrusion mechanism by moving the applicator member relative to the cover member while the applicator tip is within the open end. In one embodiment, this is accomplished by components that move a piston toward the open end when the applicator is rotated relative to the cover member.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figures 1, 2, 5, 6:
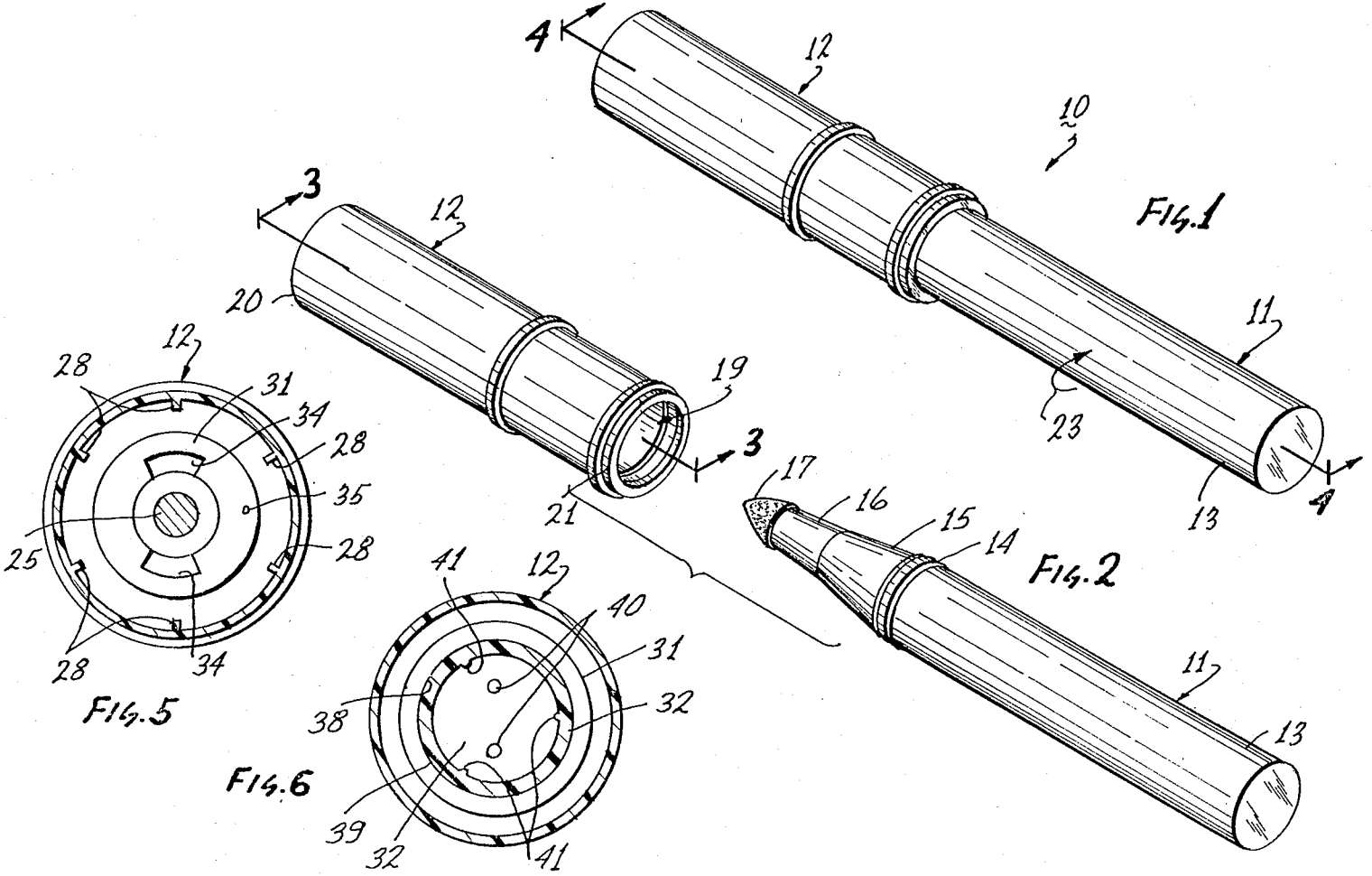
FIG. 1 of the drawings is a perspective view of a lipstick dispenser constructed according to the invention.
FIG. 2 is another perspective view similar to FIG. 1 showing the applicator member separated from the cover member.
FIG. 5 is a transverse cross section taken on line 5—5 of FIG. 3 showing the filler holes, the vent hole, and the piston-engaging, antirotation ribs.
FIG. 6 is a transverse cross section taken on line 6—6 of FIG. 3 showing the extrusion holes and the applicator-engaging, drive ribs.

Referring now to the drawings, there is shown a dispenser 10 constructed according to the invention. Generally, the dispenser 10 includes an applicator member or applicator 11 and a cover member or cover 12 (FIG. 1). These can be separated for use, as illustrated in FIG. 2, and be rejoined for storage as shown in FIG. 1.

The applicator 11 includes a hollow handle 13 composed of a suitably rigid material, such as a metal alloy, and it is joined with a cylindrically shaped plastic plug 14 to a hollow forward portion 15 of the applicator 11. The forward portion 15 has a neck 16 that extends to an applicator tip or tip 17, and the tip 17 is used for lipstick application purposes.

For this purpose the tip 17 may be composed of a closed cell neoprene foam rubber material, for example, that is skinned to expose some surface cells. Other tip materials may be employed, however, within the broader inventive concepts disclosed.

The cover 12 is also composed of a suitably rigid material, such as a metal alloy, and it defines a hollow interior 19 (FIG. 2) that extends along a cover member axis 18 (FIG. 3) from a closed end 20 of the cover 12 to an open end 21 of the cover 12 (FIG. 2). The applicator 11 and the cover 12 are dimensioned and arranged so that they fit together. In other words, the open end 21 is dimensioned and arranged to receive the tip 17 as illustrated in FIGS. 1 and 4.

As an idea of size, the illustrated dispenser 10 is about ten centimeters long. Of course, this dimension is not critical. In addition, the illustrated applicator 11 and cover 12 are cylindrically shaped and about one centimeter in diameter, but various other shapes and sizes can be used.

It is necessary that the applicator 11 and the cover 12 be movable relative to each other. For this purpose, the cover 12 includes an annular groove 22 near the open end 21 (FIGS. 3 and 4) that faces radially inward to receive the plug 14 periphery. This arrangement results in the cover 12 engaging the applicator 11 in a snap-together fit that retains the cover 12 on the applicator 11 while enabling rotational movement of the applicator 11 relative to the cover 12 as indicated by an arrow 23 in FIG. 1.

Relative movement is used according to the broader aspect of the invention to drive an extrusion mechanism contained with the cover 12 along with a supply of lipstick. The extrusion mechanism operates to extrude an amount of the lipstick toward the open end 21 of the cover 12 when the applicator 11 is rotated relative to the cover 12 as depicted by the arrow 23 in FIG. 1.

The extrusion mechanism includes components that result in such operation and, thus, these components serve as means for enabling a user to operate the extrusion mechanism by moving the applicator 11 relative to the cover 12 while the tip 17 is within the open end 21. This feature results in much more convenient operation.

Figure 3:
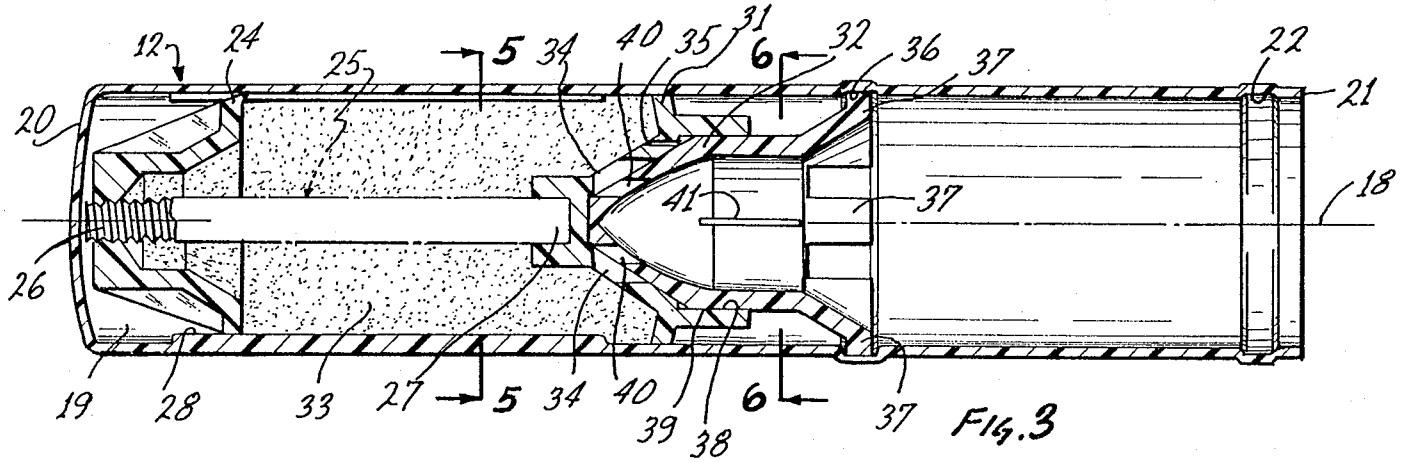
FIG. 3 is an enlarged cross sectional view of the cover member taken on line 3—3 of FIG. 2.
Figure 4:
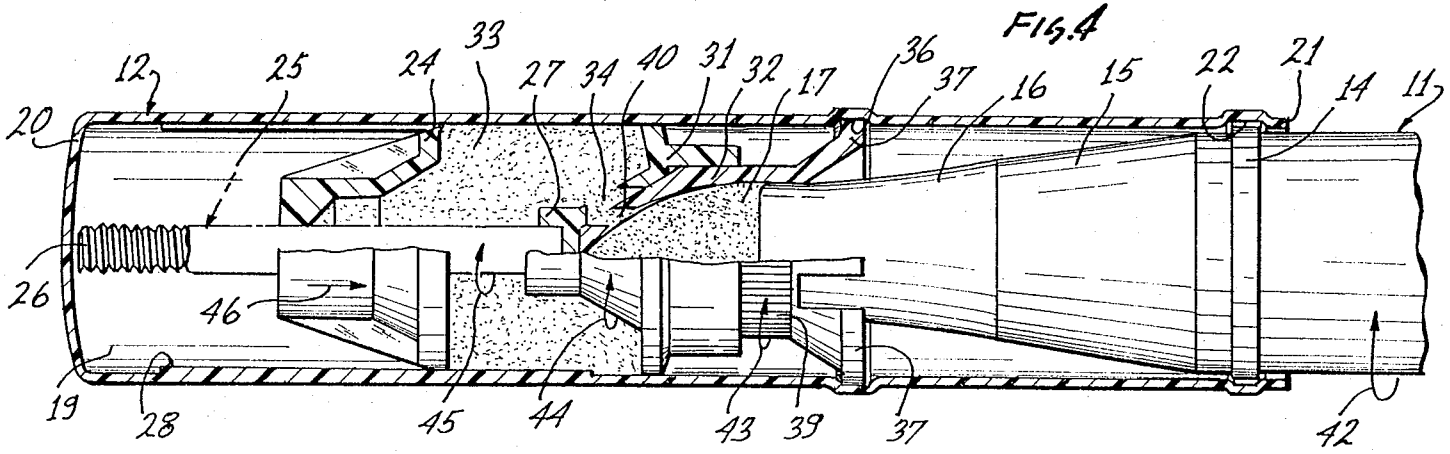
FIG. 4 is an enlarged cross sectional view taken on line 4—4 of FIG. 1.

Further details in this respect are shown in FIGS. 3 and 4. The extrusion mechanism mentioned above includes a piston 24 within the hollow interior 19 of the cover 12. A threaded shaft 25 composed of a suitable material, such as steel, is disposed within the hollow interior 19. There, it extends generally along the cover member axis 18 between first and second end portions 26 and 27 of the shaft 25, the second end portion 27 of which is disposed toward the open end 21 of the cover member 12.

At least a portion of the shaft 25 is threaded and the shaft 25 passes through the piston 24 so that rotation of the shaft 25 relative to the cover 12 causes the piston 24 to move toward the open end 21 of the cover 12. In other words, the piston 24 engages threads on the shaft 25.

In this regard, the piston 24 may be composed of an injection molded thermoplastic material and define a hole through which the shaft 25 passes, radially inwardly protruding members around the hole periphery serving to engage threads on the shaft 25. These details of the piston 24 are not illustrated, and other known means of engaging threads on the shaft 25 may be employed.

The cover 12 includes means for preventing the piston 24 from rotating with the shaft 25. This is accomplished in the device 10 with a plurality of inwardly-protruding, longitudinally-extending ribs 28 formed in the cover member 12 (FIGS. 3–5). The piston 24 is suitably configured so that the ribs 28 engage the piston 24 to prevent rotation of the piston 24 while allowing axially movement. The piston 24 may have a circularly shaped periphery that deforms slightly to conform to the shape of the ribs 28, for example.

Thus, the extrusion mechanism mentioned above includes means for moving the piston 24 toward the open end 21 of the cover member 12 when the extrusion mechanism is operated in order to thereby move a quantity of lipstick 33 within the cover 12 toward the open end 21. The means for doing this includes shaft 25 within the hollow interior 19 of the cover member 12.

It also includes a bulkhead web or first coupler member 31 (FIGS. 3–5) and a cavity guide or second coupler member 32 (FIGS. 3, 4, and 6). These two coupler members combine as coupler means for enabling the user to couple the shaft 25 to the applicator 11 when the tip 17 is within the open end 21 of the cover 12 so that rotation of the applicator 11 relative to the cover 12 causes the shaft 25 to rotate.

The first coupler member 31 may be composed of an injection molded thermoplastic material configured to conform to the cross sectional shape of the hollow interior 19, this being circularly for the cover 12. It is connected to the second end portion 27 of the shaft 25 by suitable means, such as a press fit within a hole in the first coupler member 31, and it facilitates assembly.

In assembling the dispenser 10, the manufacturer first assembles the piston 24, the shaft 25, and the first coupler member 31. Once assembled, they are inserted through the open end 21 into the hollow interior 19 of the cover 12, and a quantity of lipstick 33, depicted by the stippling in FIGS. 3 and 4, is injected into the cover 12 through a pair of filler holes 34 in the first coupler member 31 (FIGS. 3–5). The quantity of lipstick 33 may be in a relatively less viscous state when it is injected, and the first coupler member 31 may include a vent hole 35 for venting air from the hollow interior 19 as the lipstick 33 is injected.

Then, the second coupler member 32 is inserted through the open end 21 of the cover 12 into the hollow interior 19. There, it is advanced toward the closed end 20 of the cover 12 until it abuts the first coupler member 31 and snaps into an inwardly facing annular groove 36 (FIGS. 3 and 4) in the cover 12. The second coupler member 32 may be composed of an injection molded thermoplastic material with a circularly shaped periphery that defines deformable tabs 37 for this purpose, the tabs 37 deforming slightly as the second coupling member 32 is inserted and then recovering to snap into the groove 36. As shown in FIGS. 3 and 4, the coupler member 32 defines a cavity opening toward the open end 21 of the cover 12.

This retains the first and second coupler members 31 and 32 within the cover 12 by engaging the second cover member 32. In addition, the second coupling member 32 is engaged so that it can be rotated. A first serrated surface 38 on the first coupling member 31 (FIGS. 3 and 6) mates with a second serrated surface 39 on the second coupling member 32 to couple the first and second coupling members 31 and 32 together so that when the second coupling member 32 is rotated, the first coupling member 31 rotates also.

The first and second surfaces 38 and 39 are serrated in the sense that they define mating serrations that result in rotational movement of the second coupling member 32 being coupled to the first coupling member 31. Other means of accomplishing this result may be employed, such as protrusions from one of the two surfaces that extend into indentations in the other, for example.

When the second coupling member 32 is rotated, the first coupling member 31 rotates. This results in the shaft 25 rotating and the piston 24 moving axially toward the open end 21 while the ribs 28 prevent piston rotation. As this occurs, the piston moves the lipstick 33 toward the open end 21 so that the lipstick 33 passes through the filler holes 34. As movement of the lipstick 33 continues, it is extruded through a pair of extrusion holes 40 in the second coupling member 32 (FIGS. 3, 4, and 6). As shown in FIG. 4, the applicator tip 17 covers the extrusion hole 40.

The dispenser 10 includes means for engaging the applicator 11 with the second coupler member 32 when the tip 17 is advanced through the open end 21 of the cover 12 toward the second coupler member 32 so that rotation of the applicator 11 relative to the cover 12 causes the shaft 25 to rotate. This is accomplished in the illustrated dispenser 10 with a plurality of longitudinally extending drive ribs or ribs 41 that protrude radially inwardly from the second coupling member 32 (FIGS. 3 and 6).

The ribs 41 are dimensioned and arranged to bear against and thereby engage the neck 16 of the applicator 11 when the tip 17 is advanced sufficiently into the cover 12. Thus, the ribs 41 and the region of the neck 16 against which the ribs bear constitute interengaging means for releasably attaching the applicator 11 to the cover 12 so that these members can be separated for use and rejoined for storage. Preferably, this engagement occurs when the applicator 11 is advanced to the storage the position illustrated in FIG. 4.

In order to extrude the lipstick 33 (i.e., advance it onto the tip 17), the user rotates the applicator 11 relative to the cover 12. This is done by grasping the cover 12 with one hand and the applicator 11 with the other hand and then rotating the two relative to each other as depicted by an arrow 42 in FIG. 4. Doing this results in the second coupler member 32, the first coupler member 31, and the shaft 25 rotating as depicted by arrows 43–45 in FIG. 4, and this in turn results in the piston 24 moving as depicted by an arrow 46.

After extruding some lipstick in this manner, the user separates the applicator 11 from the cover 12 and uses the lipstick-covered tip 17 to apply the lipstick as desired.

Thus, this invention provides a new and improved lipstick dispenser that can be used without releasing either the cover 12 or the applicator 11. In addition, the user can spread the lipstick more evenly over the surface of the tip. Furthermore, the clever combination of extrusion components greatly facilitates fabrication.

Although an exemplary embodiment of the invention has been shown and described, many changes, modifications, and substitutions may be made by one having ordinary skill in the art without necessarily departing from the spirit and scope of the invention. For example, the claimed combination of elements may be used for a flowable substance other than lipstick, such as glue or grease and the like. Thus, the use herein of the word "lipstick" is intended to include all such other flowable substances.

What is claimed is:

1. A lipstick dispenser, comprising:

an applicator member and a cover member that can be separated for use and rejoined for storage;

the applicator member having an applicator tip to be used for lipstick application purposes;

the cover member having a hollow interior that extends along a cover member axis to an open end of the cover member, which open end is dimensioned and arranged to receive the applicator tip;

the cover member containing a supply of lipstick and an extrusion mechanism for extruding an amount of the lipstick toward the open end; and the extrusion mechanism including means for enabling a user to operate the extrusion mechanism by moving the applicator member relative to the over member while the applicator tip is within the open end.

2. A dispenser as recited in claim 1, wherein the extrusion mechanism includes:

a piston within the hollow interior of the cover member; and means for moving the piston toward the open end of the cover member when the extrusion mechanism is operated in order to thereby move the lipstick toward the open end.

3. A dispenser as recited in claim 2, wherein:

the means for moving the piston includes a shaft within the hollow interior of the cover member;

the shaft extends generally along the cover member axis between first and second end portions of the shaft, the second end portion of which is disposed toward the open end of the cover member;

at least a portion of the shaft is threaded; and the shaft passes through the piston so that rotation of the shaft relative to the cover member causes the piston to move toward the open end of the cover member.

4. A dispenser as recited in claim 3, wherein the cover member includes:

means for preventing the piston from rotating with the shaft.

5. A dispenser as recited in claim 3, wherein:

the shaft includes a threaded portion; and the piston is arranged to engage the threaded portion so that rotation of the shaft causes the piston to move toward the open end of the cover member.

6. A dispenser as recited in claim 3, wherein the means for moving the piston includes:

coupling means for enabling the user to couple the shaft to the applicator member when the applicator tip is within the open end of the cover member so that rotation of the applicator member relative to the cover member causes the shaft to rotate.

7. A dispenser as recited in claim 6, wherein the means for enabling the user to couple the shaft to the applicator member includes:

a coupler mechanism connected to the second end portion of the shaft, which coupler mechanism is rotatably mounted within the hollow interior of the cover member intermediate the shaft and the open end of the cover member; and means for engaging the applicator member with the coupler mechanism when the applicator tip is advanced through the open end of the cover member toward the coupler mechanism so that rotation of the applicator member relative to the cover member causes the shaft to rotate.

8. A dispenser as recited in claim 7, wherein the coupler mechanism includes:

a first coupler component connected to the second end portion of the shaft, which first coupler component defines at least one filler hole;

a second coupler component rotatably mounted in the hollow interior of the cover member intermediate the first coupler component and the open end of the cover member, which second coupler component defines at least one extrusion hole; and means for coupling the first coupler component to the second coupler component in order to enable assembly of the cover member by first placing the shaft, piston, and first coupler component into the cover member, then adding a quantity of lipstick through the filler hole, and thereafter rotatably mounting the second coupler component within the cover member, coupled to the first coupler component so that rotation of the second coupler component results in the lipstick extruding through the extrusion hole toward the open end.

9. A dispenser as recited in claim 1, wherein the extrusion mechanism includes:

means for enabling a user to operate the extrusion mechanism by rotating the applicator member relative to the cover member while the applicator tip is within the open end.

10. A dispenser as recited in claim 1, wherein the extrusion mechanism includes:

means for enabling a user to disengage the extrusion mechanism by withdrawing the applicator member from the cover member slightly.

11. A flowable substance dispenser, comprising:

an applicator member and a cover member that can be separated for use and rejoined for storage;

the applicator member having an applicator tip to be used for flowable substance application purposes;

the cover member having a hollow interior that extends along a cover member axis to an open end of the cover member, which open end is dimensioned and arranged to receive the applicator tip;

the cover member containing a supply of flowable substance and an extrusion mechanism including a piston and means for enabling a user to move the piston toward the open end of the cover member by rotating the applicator member relative to the cover member.

12. A flowable substance dispenser, comprising:

an applicator member and a cover member that can be separated for use and rejoined for storage;

the applicator member having an applicator tip to be used for flowable substance application purposes;

the cover member having a hollow interior that extends along a cover member axis to an open end of the cover member, the applicator tip being receivable through the open end into the hollow interior;

the cover member containing a supply of flowable substance; and extrusion means for extruding an amount of the flowable substance toward the open end and onto the applicator tip without passing through the applicator tip.

13. The dispenser of claim 12 wherein the extrusion means includes a piston and means to enable a user to move the piston toward the open end of the cover member by rotating the cover member relative to the applicator member with the applicator tip within the open end.

14. The dispenser of claim 12 including interengaging means on the applicator member and the cover member for releasably attaching the applicator member to the cover member.

15. A dispenser for a flowable substance comprising:

an applicator member including a handle which can be manually grasped and an applicator tip coupled to the handle, said applicator tip including cellular material with cells at the surface of the applicator tip;

a cover member having an open end and a hollow interior:

a flowable substance in the hollow interior of the cover member;

the applicator tip being receivable through the open end into the hollow interior of the cover member;

the applicator member and the cover member being separable; and manually operable means for extruding the flowable material in the cover member toward the applicator tip and onto the surface of the applicator tip without passing through the applicator tip.

16. The dispenser of claim 15 including interengaging means on the applicator member and the cover member for releasably attaching the applicator member to the cover member.

17. A dispenser for a flowable substance comprising:

an applicator member including a handle which can be manually grasped and an applicator tip coupled to the handle, said applicator tip including foam material;

a cover member having an open end and a hollow interior;

a first member mounted in the hollow interior of the cover member, said first member defining a cavity opening toward the open end of the cover member and an extrusion hole leading to the cavity;

a piston in the hollow interior of the cover member, said first member being between the piston and the open end of the cover member;

a flowable substance in the hollow interior of the cover member between the first member and the piston;

the applicator tip being receivable through the open end of the cover member and into the cavity of the first member to cover the extrusion hole, the applicator member and the cover member being separable; and manually operable means for moving the piston toward the first member to extrude the flowable substance through the extrusion hole and onto the applicator tip.

18. The dispenser of claim 17 wherein the foam material includes cells at the surface of the applicator tip.

19. The dispenser of claim 17 wherein the flowable substance is extruded through the extrusion hole and onto the surface of the applicator tip without passing through the applicator tip.

20. The dispenser of claim 17 wherein the first member is mounted for rotation relative to the cover member and including means for releasably drivingly coupling the applicator member and the first member whereby the applicator member can rotate the first member and means responsive to rotation of the first member for moving the piston toward the first member to extrude the flowable material through the extrusion hole and onto the applicator tip.

21. A dispenser for a flowable substance comprising:

an applicator member including a handle which can be manually grasped and an applicator tip coupled to the handle;

a cover member having an open end and a hollow interior;

a first member mounted in the hollow interior of the cover member, said first member defining a cavity opening toward the open end of the cover member and an extrusion hole leading to the cavity;

a piston in the hollow interior of the cover member, said first member being between the piston and the open end of the cover member;

the cover member extending beyond the first member to the open end of the cover member;

a flowable substance in the hollow interior of the cover member between the first member and the piston;

the applicator tip being receivable through the open end of the cover member and into the cavity of the first member;

interengaging means on the applicator member and the cover member for releasably attaching the applicator member to the cover member; and manually operable means for moving the piston toward the first member to extrude the flowable substance through the extrusion hole and onto the applicator tip.

* * * * *